US011933179B2

(12) United States Patent
Anderson et al.

(10) Patent No.: US 11,933,179 B2
(45) Date of Patent: Mar. 19, 2024

(54) BRINE EXTRACTION WELL SYSTEM

(71) Applicant: Genesis Alkali Wyoming, LP, Philadelphia, PA (US)

(72) Inventors: Adam Clark Anderson, Fort Bridger, WY (US); Aaron P. Reichl, Green River, WY (US)

(73) Assignee: GENESIS ALKALI WYOMING, LP, Philadelphia, PA (US)

( * ) Notice: Subject to any disclaimer, the term of this patent is extended or adjusted under 35 U.S.C. 154(b) by 6 days.

(21) Appl. No.: 17/946,152

(22) Filed: Sep. 16, 2022

(65) Prior Publication Data

US 2023/0228194 A1 Jul. 20, 2023

Related U.S. Application Data

(60) Provisional application No. 63/245,116, filed on Sep. 16, 2021.

(51) Int. Cl.

| | |
|---|---|
| ***E21F 16/00*** | (2006.01) |
| ***E21B 43/10*** | (2006.01) |
| ***E21B 43/12*** | (2006.01) |
| ***E21B 47/047*** | (2012.01) |
| ***E21B 47/06*** | (2012.01) |

(52) U.S. Cl.

CPC ..... *E21F 16/00* (2013.01); *E21B 43/10* (2013.01); *E21B 43/128* (2013.01); *E21B 47/047* (2020.05); *E21B 47/06* (2013.01)

(58) Field of Classification Search

CPC ..... E21B 43/10; E21B 43/128; E21B 47/047; E21B 47/06; E21F 16/00

See application file for complete search history.

(56) References Cited

U.S. PATENT DOCUMENTS

| | | | | |
|---|---|---|---|---|
| 4,349,228 | A * | 9/1982 | Rohde | E21F 16/00 166/50 |
| 7,571,771 | B2 * | 8/2009 | Pratt | E21B 43/121 166/50 |
| 2005/0217350 | A1 * | 10/2005 | Jabusch | E21B 47/008 73/64.55 |
| 2014/0013744 | A1 * | 1/2014 | Burkhardt | F24T 10/30 60/641.2 |
| 2022/0213886 | A1 * | 7/2022 | Al-Gouhi | F04B 47/06 |

* cited by examiner

*Primary Examiner* — Brad Harcourt

(74) *Attorney, Agent, or Firm* — Hasley Scarano, L.L.P.

(57) ABSTRACT

An extraction well system is disclosed that allows for isolation of electrical cables from underground mine atmosphere. The extraction well system provides for a well casing that extends downwardly proximate to an existing mine cavity and an extension casing that extends downwardly below the mine roof. In one embodiment the extension casing is external to the well casing and is attached to the well casing mechanically such as with a dual thread reducer. The extension runs from above the mine roof to below the mine floor and is perforated in the area of the mine cavity to allow liquid to drain into the bottom of the extension well. In a second embodiment, the extension casing is interior to the well casing and is attached for example by an internal liner hanger. In this embodiment, the extension casing runs from above the mine roof to below the desired minimum liquid level and it is the well casing that extends downwardly in the extension well and which is perforated to allow liquids to flow into the well.

18 Claims, 3 Drawing Sheets

BRINE EXTRACTION WELL SYSTEM

CROSS-REFERENCE TO RELATED APPLICATIONS

This application claims priority to U.S. Provisional Application No. 63/245,116 ("the '116 Application") filed Sep. 16, 2021. The '116 Application is hereby incorporated by reference in its entirety for all purposes, including but not limited to, all portions describing the extraction system of the present invention and the embodiments disclosed, those portions describing mine extraction wells, brine removal systems, down hole well pumps, and electrical safety systems in general as background and for use with specific embodiments of the present invention, and those portions describing other aspects of the method and systems that may relate to the present invention.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a method and system for removing liquids through, an extraction well. More particularly, the present invention relates to a method and a system for separating electrical cables operating a down hole well pump from potentially dangerous gases while removing liquids through an extraction well. Even more particularly, the present invention relates to a method and a system for separated electrical cables operating a down hole well pump from potentially dangerous gases while removing water or brine from a mine cavity through an extraction well.

2. Description of the Related Art

As shown in FIG. 1, some current versions of mine water extraction wells include a well pump 100 with electric motor 102 submerged in the bottom 112 of the well 110. The electric power cable 104 for running the pump motor 102 runs to the surface along the pump discharge 106 inside the well casing 114. The outer casing 114 is perforated to create a perforated section 116 at the mine 140 level to allow water/brine from the mine 140 to flow into the pump suction shroud 108 so it can be pumped up and out of the mine 140. One problem with this arrangement is that to the extent the mine 140 may contain potentially dangerous gases, those gases could migrate to the inside of the casing 114 and come in contact with the electrical cable 104. Some have proposed running an inner casing and outer casing through the entire well to separate the electric cables from any mine atmosphere. This solution is inefficient adding significant weight and costs to the extraction well. There is a significant need to be able to isolate electrical cables for operating an extraction well pump from potentially dangerous gases that might be encountered without the inefficiencies of running two casings from the surface.

BRIEF SUMMARY OF THE INVENTION

The present invention is an improved extraction well system that allows for isolation of electrical cables from the mine atmosphere. The extraction well system provides for a well casing that extends downwardly proximate to an existing mine cavity and an extension casing that extends downwardly below the mine roof. In one embodiment the extension casing is external to the well casing and is attached to the well casing mechanically such as with a dual thread reducer. The extension runs from above the mine roof and is perforated in the area of the mine cavity to allow liquid to drain into the bottom of the extraction well. In a second embodiment, the extension casing is interior to the well casing and is attached for example by an internal liner hanger. In this embodiment, the extension casing runs from above the mine roof to below the desired minimum liquid level and it is the well casing that extends downwardly in the extraction well and which is perforated to allow liquids to flow into the well.

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

A better understanding of the present invention can be obtained when the following detailed description of the disclosed embodiments is considered in conjunction with the following drawings in which.

DETAILED DESCRIPTION OF THE INVENTION

The present invention is an improved extraction well system that allows for isolation of electrical cables from the mine atmosphere. The extraction well system provides for a well casing that extends downwardly proximate to an existing mine cavity and an extension casing that extends downwardly below the mine roof. The liquid level in the extraction well is maintained above the level of the mine floor. A perforated area in, either the casing or extension, depending upon the embodiment, allows mine water to flow into the bottom portion of the well where the pump, which is submerged in the water, can pump the mine water out the pump discharge and out of the mine. The pump's electrical cables are isolated from mine gases under this arrangement.

Figure 1:
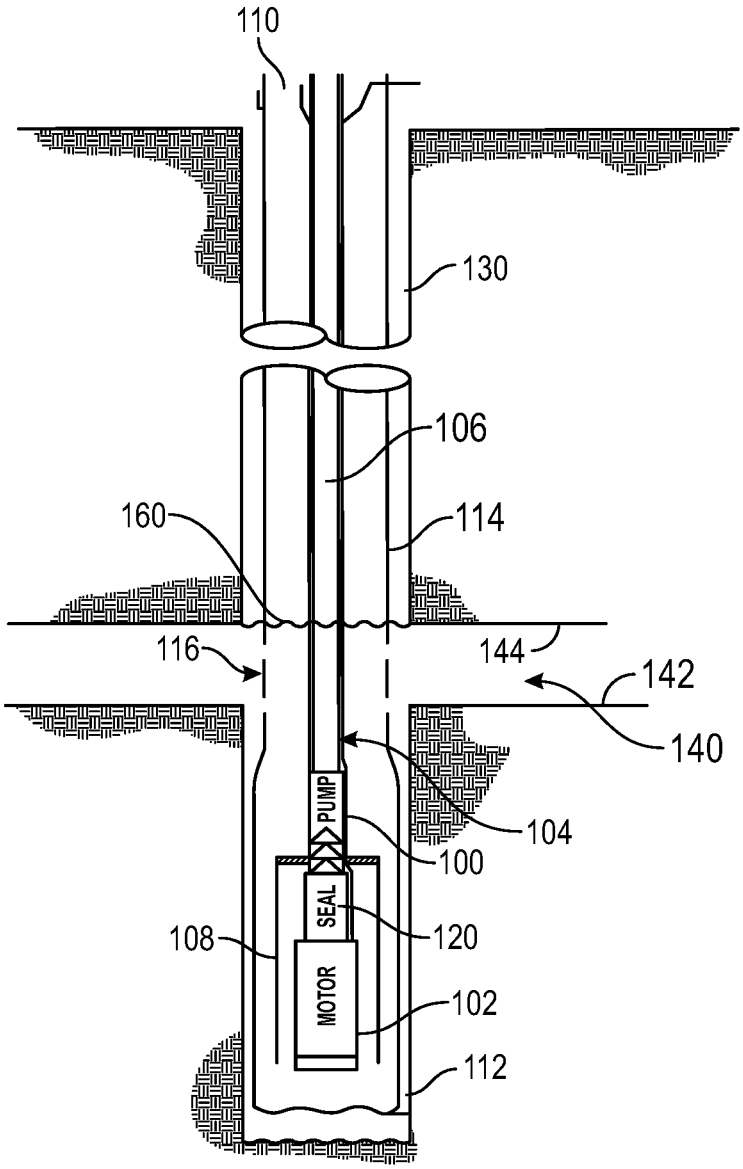
FIG. 1 Prior Art
FIG. 1 is a profile view of an embodiment of an existing prior art mine water well with submerged well pump.
Figure 2:
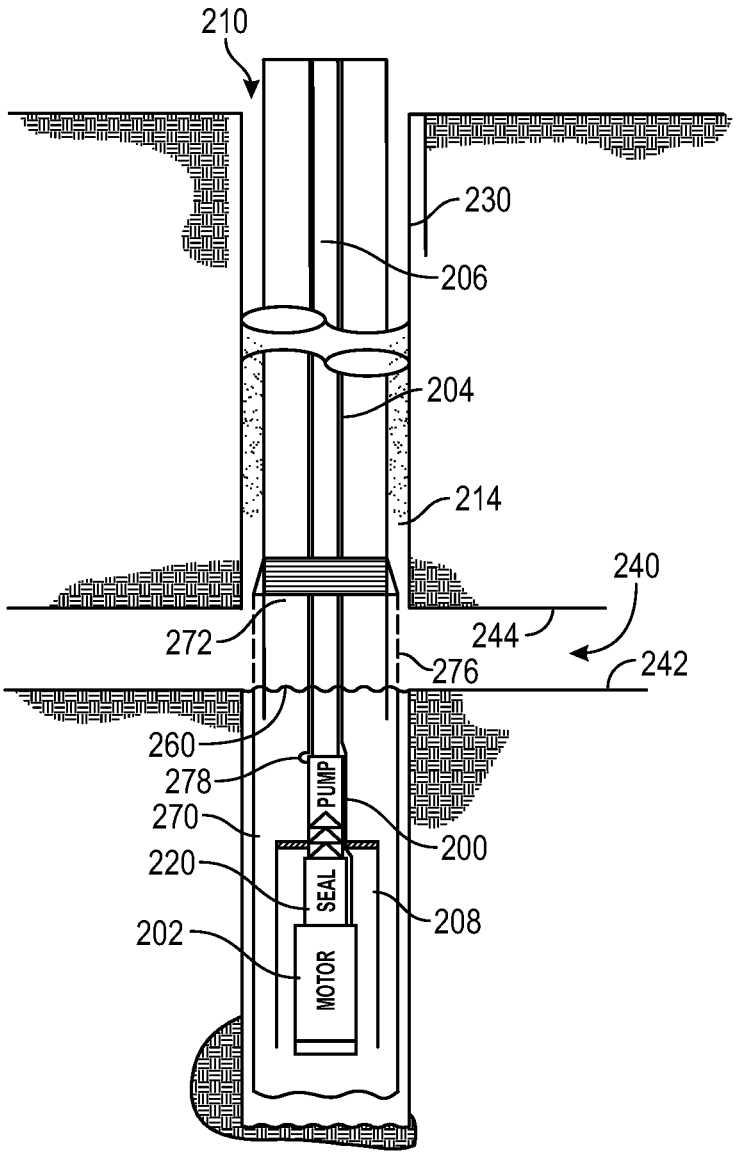
FIG. 2 is a profile view an embodiment of the improved mine water well with submerged well pump utilizing a dual threaded reducer for extending casing externally.

One embodiment of the improved, extraction well system is shown in FIG. 2. In this embodiment an extension casing 270 is external to well casing 214 and is attached to the well casing 214 mechanically such as with a dual thread reducer 272. The extension 270 runs from above the mine roof 244 and is perforated in the area of the mine cavity 240 to allow liquid to drain into the bottom of the extraction well 210. As an example, for a 19 inch bore hole, the well casing might be a 13⅜ inch STC casing, the extension casing might be 16 inch stainless steel, and the dual threaded reducer might be a 16 inch by 13⅜ inch dual threaded reducer. More particularly, in this embodiment, main casing 214 is grouted to the surface of well bore 230 and extends downwardly through mine 240 and to below the desired minimum liquid level 260. Dual threaded reducer 272 attaches to an outside portion of main casing 214, preferably above mine roof 244. Extension 270 affixes to dual threaded reducer 272, preferably above mine roof 244, and extends downwardly into well 210 below the mine floor and preferably below the pump 200 and motor 202 proximate to the bottom of well 210. A portion of the extension 270 that is exposed to mine 240 and overlapping main casing 214 is perforated to allow mine water to flow from mine 240 into the bottom portion of well 210 below mine surface 242. Preferably, in this improved well extraction system there is a water level indicator 278, such as a pressure transducer that senses head pressure, that prevents the pump 200 from pumping the liquid level 260 too low, preferably maintaining the level above the level of the mine floor 242. In this arrangement, the power cables 204 leading to pump motor 202 are isolated from exposure to the mine atmosphere by the unperforated main casing 214 in combination with the mine water in the bottom portion of the well 210.

Figure 3:
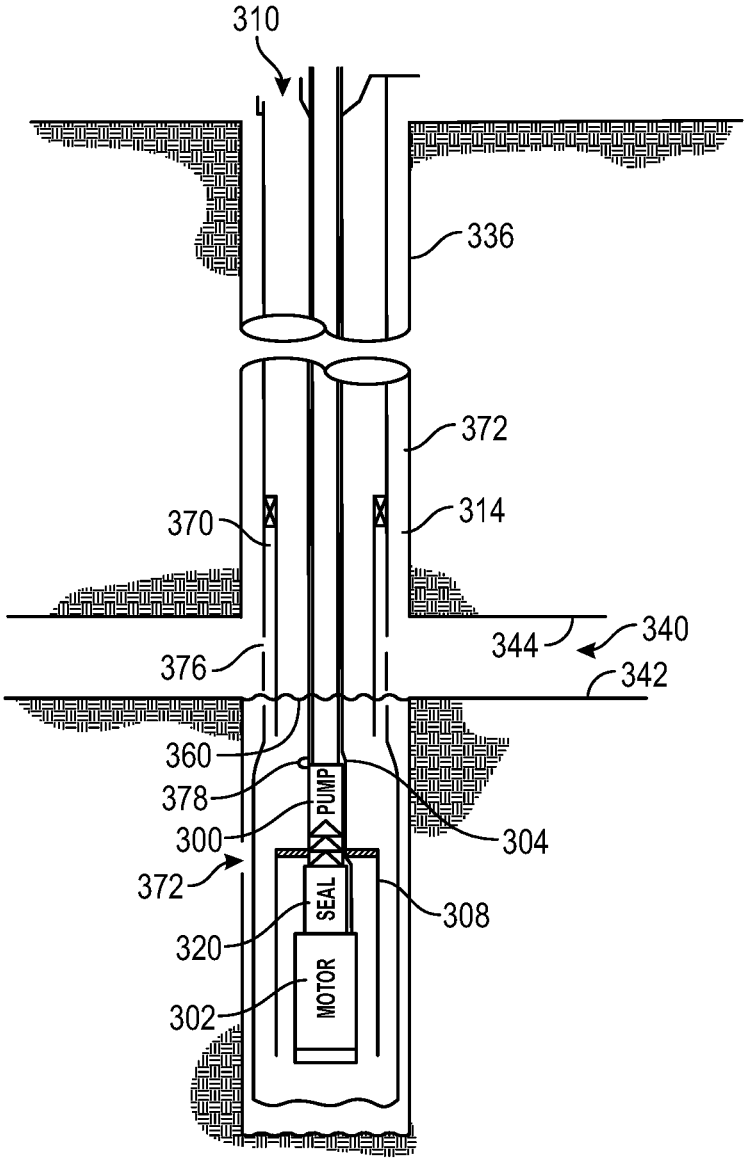
FIG. 3 is a profile view a second embodiment of the improved mine water well with submerged well pump utilizing a liner hanger for extending casing internally.

A second embodiment of the improved extraction well system is shown in FIG. 3. In this second embodiment, an extension casing or liner 370 is interior to the well casing 314 and is attached for example by an internal liner hanger 372. In this embodiment, the extension casing 370 runs from above the mine roof 344 to below the desired minimum liquid level 360 and it is the well casing 314 that extends downwardly in the bottom of the extraction well 310 and which is perforated to allow liquids to flow into the well. More particularly, in this embodiment, main casing 314 is grouted to the surface of well bore 330 and extends downwardly through mine 340 and into the bottom of the well 310 into mine floor 342. Internal liner hanger 372 attaches to an inside portion of main casing 314, preferably at a level above mine roof 344. Extension 370 affixes to hanger 272, preferably above mine roof 344, and extends downwardly into well 310 below the desired minimum liquid level 360. A portion of casing 314 that is exposed to mine 340 and overlapping internal extension 370 is perforated to allow mine water to flow from mine 340 into the bottom portion of well 310 below mine surface 342. Preferably, in this improved well extraction system there is a water level indicator 378, such as a pressure transducer that senses head pressure, that prevents the pump 300 from pumping the liquid level 360 too low, preferably maintaining the level proximate to the level of the mine floor 342. In this arrangement, the power cables 304 leading to pump motor 302 are isolated from exposure to the mine atmosphere by the unperforated liner 370 in combination with the mine water in the bottom portion of the well 310.

The bottom portion of the casing 214 or 314 can be 16" SS (stainless steel), carbon steel or other material as warranted by the circumstances. As a person of ordinary skill in the art would recognize, this refers to the outside diameter of the casing and the size of the casing used in the extraction well is not limited but can be determined based upon the conditions encountered. Likewise, the size of the well casing 214 or 314 may be, for example, 13⅜ inches, but can vary depending upon the well design. For the embodiment of FIG. 2, the outer extension 270 casing could be 16" OD for a 13⅜" OD well casing 214, but these dimensions may vary with the project. For the embodiment of FIG. 3, the interior extension 370 could have a 10¾" OD for a 13⅜" OD well casing 314, but these dimensions may also vary with the project. As a person of ordinary skill in the art will now recognize, the gap between the casing and the extension should be adequate to avoid a flow restriction. The perforations in the perforated area 276 or 376 the exterior extension 270 of FIG. 2 and the casing 314 of FIG. 3 can be slots or holes or other appropriate shapes. In some embodiments, the perforations will be ½" diameter holes.

These embodiments preferably maintain the water level at the mine floor or above while the inner casing extends below the mine floor. These embodiments essentially function like a p-trap by maintaining isolation of the electrical systems from mine atmosphere while allowing mine water to reach the pump intake. Preferably, additional safety conditions may be applied to prevent exposure of the electrical systems to the mine atmosphere including automatic interlocks that deenergize the pump in the event the water level falls below the mine floor at the pump's location, preventing the restarting of the pump motor anytime the water level is below the mine floor at the pump location, and, equipping the pump installation with a water level indicator located at its electrical controls such that the water level at the pump can be determined before the pump is restarted.

As can be seen from the figures, including the dimensions disclosed thereon, a person of ordinary skill in the art could now manufacture and use the disclosed extraction well system. A person of ordinary skill in the art would recognize that the precise dimensions and the materials of construction for the extraction well system can depend upon the mining system in which the extraction well is being utilized.

While the terms used herein are believed to be well-understood by one of ordinary skill in the art, definitions are set forth to facilitate explanation of certain of the presently-disclosed subject matter.

Following long-standing patent law convention, the terms "a", "an", and "the" refer to one or more when used in this application, including the claims. Thus, for example, reference to "a window" includes a plurality of such windows, and so forth.

Unless otherwise indicated, all numbers expressing quantities of elements, dimensions such as width and area, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of a dimension, area, percentage, etc., is meant to encompass variations of in some embodiments plus or minus 20%, in some embodiments plus or minus 10%, in some embodiments plus or minus 5%, in some embodiments plus or minus 1%, in some embodiments plus or minus 0.5%, and in some embodiments plus or minus 0.1% from the specified amount, as such variations are appropriate to perform the disclosed methods or employ the disclosed compositions.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter. With respect to the terms "comprising", "consisting of", and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, S, C, and/or O" includes A, S, C, and O individually, but also includes any and all combinations and subcombinations of A, S, C, and O.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. The foregoing disclosure and description are illustrative and explanatory thereof, and various changes in the details of the illustrated apparatus and construction and method of operation may be made without departing from the spirit in scope of the invention which is described by the following claims.

We claim:

1. A method of safely removing brine from a mine cavity having a roof and a floor utilizing an extraction well comprising:

drilling a well bore to a desired depth through the mine, said wellbore having an upper portion above the mine roof and a termination portion below the mine floor;

installing a main casing inside the well bore, said main casing having a lower end, an inside diameter, and an outside diameter, the lower end being below a desired minimum liquid level;

securing an outer casing externally to the lower end of the main casing, said outer casing being secured at an outer casing top end to said main casing and having a bottom end projecting downward through the mine cavity into the termination portion of the well bore, said outer casing having an internal diameter greater than the outer diameter of the outside diameter of said main casing, said outer casing having perforations in a portion exposed to the mine cavity for allowing mine fluids to flow into the termination portion of the well bore;

inserting a pump for pumping brine out of the cavity, said pump having a discharge line, a pump discharge, a pump motor, and an electric power cable, said pump motor being positioned in the well bore below the main casing, said discharge line being connected to said pump discharge on one end and having a surface discharge on an opposite end above the upper portion of the well bore, the discharge line being positioned interior to the inside diameter of said main casing and extending downwardly to the pump discharge, said electric power cable being operably connected to the pump motor and an electrical power source on the surface, the power cable being positioned inside the main casing and extending downwardly to the pump motor;

establishing a minimum level for brine inside the termination portion of the well bore above the lower end of the main casing utilizing a liquid level indicator;

and pumping excess brine from the terminal portion of the well bore with the pump through the pump discharge line to the surface discharge;

whereby the liquid in the termination portion of the well bore isolates mine gases from the interior of the main casing and the electric power cable powering the pump.

2. The method of claim 1 wherein said outer casing is secured to said main casing by means of a dual threaded reducer.

3. The method of claim 1 wherein said outer casing has an internal diameter at least about ½" inch greater than the outer diameter of said main casing.

4. The method of claim 1 wherein said perforations in said outer casing comprise slots.

5. The method of claim 1 wherein said perforation in said outer casing comprises circular perforations having a diameter between about ¼ inch and 1 inch.

6. The method of claim 1 wherein the pump motor is deenergized should the brine level fall below the mine floor.

7. The method of claim 1 wherein liquid level in the well can be determined prior to starting the pump.

8. The method of claim 1 wherein the liquid level indicator comprises a pressure transducer for sensing liquid head pressure.

9. A method of safely removing brine from a mine cavity having a roof and a floor utilizing an extraction well comprising:

drilling a well bore to a desired depth through the mine roof said well bore having an upper portion above the mine roof and a termination portion below the mine floor installing a main casing inside the well bore, said main casing having a lower end, an inside diameter, and an outside diameter, the lower end extending below the mine floor, said main casing having perforations in a portion exposed to the mine cavity for allowing mine fluids to flow into the termination portion of the well bore;

secure an inner casing inside said main casing, said inner having an upper end secured inside said main casing proximate to but above the perforations in the main casing, and a lower end extending downwardly through the main casing below a desired minimum liquid level, said inner casing having an external diameter smaller than the inside diameter of said main casing;

inserting a pump for pumping brine out of the cavity, said pump having a discharge line, a pump discharge, a pump motor, and an electric power cable, said pump motor being positioned in the well bore below said inner casing liner, the discharge line being operably connected to said pump discharge on one end and having a surface discharge on an opposite end above the upper portion of the well bore, the discharge line being positioned interior to the inside diameter of said main casing and inner casing and extending downwardly to the pump discharge, said electric power cable being operably connected to the pump motor and an electrical power source on the surface, the power cable being positioned inside the main casing and inner casing liner and extending downwardly to the pump motor;

establishing the minimum level for brine inside the termination portion of the well bore above the bottom end of said inner casing liner utilizing a liquid level indicator to control said pump;

and pumping excess brine from the terminal portion of the well bore with the pump through the pump discharge line to the surface discharge;

whereby brine in the termination portion of the well bore isolates mine gases from the interior said inner casing liner and main casing above the liner hanger, and the electrical cable.

10. The method of claim 9 wherein said inner casing is secured to said main casing by means of an internal liner hanger.

11. The method of claim 9 wherein said inner casing has an external diameter at least about ½ inch smaller than the inner diameter of said main casing.

12. The method of claim 9 wherein said perforations in said main casing comprise slots.

13. The method of claim 9 wherein said perforation in said main casing comprises circular perforations having a diameter between about ¼ inch and 1 inch.

14. The method of claim 9 wherein the pump motor is deenergized should the brine level fall below the mine floor.

15. The method of claim 9 wherein liquid level in the well can be determined prior to starting the pump.

16. The method of claim 9 wherein the liquid level indicator comprises a pressure transducer for sensing liquid head pressure.

17. A brine extraction well system for extracting brine from an underground mine having a mine roof and a mine floor comprising:

a well bore passing through the mine, said well bore having an upper portion at a surface and a termination portion below the mine floor;

a main casing inside the well bore, said main casing having a lower end, an inside diameter, and an outside diameter, the lower end extending below the mine floor, an outer casing secured externally to the lower end of the main casing, said outer casing being secured at an outer casing top end to said main casing and having a bottom end projecting downward through the mine cavity into the termination portion of the well bore, said outer casing having an internal diameter greater than the outer diameter of the outside diameter of said main casing, said outer casing having perforations in a portion exposed to the mine cavity for allowing mine fluids to flow into the termination portion of the well bore;

a pump for pumping brine out of the cavity, said pump having a discharge line, a pump discharge, a pump motor, and an electric power cable, said pump motor being positioned in the well bore below the main casing, said discharge line being connected to said pump discharge on one end and having a surface discharge on an opposite end above the upper portion of the well bore, the discharge line being positioned interior to the inside diameter of said main casing and extending downwardly to the pump discharge, said electric power cable being operably connected to the pump motor and an electrical power source on the surface, the power cable being positioned inside the main casing and extending downwardly to the pump motor;

a liquid level indicator for detecting brine level inside the termination portion of the well bore;

a control system for operating the pump in a manner to prevent brine level from falling below the bottom portion of the main casing thereby isolating the pump's electric power cable from any gases contained in the mine.

18. A brine extraction well system for extracting brine from an underground mine having a mine roof and a mine floor comprising:

a well bore passing through the mine, said well bore having an upper portion at a surface and a termination portion below the mine floor;

a main casing inside the well bore, said main casing having a lower end, an inside diameter, and an outside diameter, the lower end extending below the mine floor, said main casing having perforations in a portion exposed to the mine cavity for allowing mine fluids to flow into the termination portion of the well bore;

an inner casing having an upper end secured inside said main casing proximate to but above the perforations in the main casing, and a lower end extending downwardly through the main casing below a desired minimum liquid level, said inner casing having an external diameter smaller than the inside diameter of said main casing;

a pump for pumping brine out of the cavity, said pump having a discharge line, a pump discharge, a pump motor, and an electric power cable, said pump motor being positioned in the well bore below the main casing, said discharge line being connected to said pump discharge on one end and having a surface discharge on an opposite end above the upper portion of the well bore, the discharge line being positioned interior to the inside diameter of said main casing and the inside casing and extending downwardly to the pump discharge, said electric power cable being operably connected to the pump motor and an electrical power source on the surface, the power cable being positioned inside the main casing and extending downwardly to the pump motor;

a liquid level indicator for detecting brine level inside the termination portion of the well bore;

a control system for operating the pump in a manner to prevent brine level from falling below the bottom portion of the main casing thereby isolating the pump's electric power cable from any gases contained in the mine.

* * * * *